United States Patent [19]

Jones et al.

[11] 3,990,673

[45] Nov. 9, 1976

[54] APPARATUS FOR CASTING

[76] Inventors: Paul Jones, 4347 Moonlight Drive; Ferris Jones, 4307 Moonlight Drive, both of Holly, Mich. 48442

[22] Filed: Apr. 10, 1975

[21] Appl. No.: 566,901

[52] U.S. Cl. ..... 249/146; 249/152; 249/181; 249/185

[51] Int. Cl.[2] ..... B28B 7/30; B22C 9/24

[58] Field of Search ..... 249/142, 152, 181, 182, 249/178, 179, 180, 146, 184, 185

[56] References Cited

UNITED STATES PATENTS

| | | | |
|---|---|---|---|
| 904,900 | 11/1908 | Sheets | 249/152 X |
| 950,567 | 3/1910 | Kesling | 249/152 |
| 1,016,284 | 2/1912 | Meek et al. | 249/180 |
| 1,363,651 | 12/1920 | Hutchins | 249/152 X |
| 2,827,683 | 3/1958 | Benart | 249/180 |
| 2,854,725 | 10/1958 | Bast | 249/181 |
| 3,205,552 | 9/1965 | Johnson | 249/152 X |

FOREIGN PATENTS OR APPLICATIONS

| | | | |
|---|---|---|---|
| 255,593 | 10/1963 | Australia | 249/152 |

*Primary Examiner*—Francis S. Husar
*Assistant Examiner*—John S. Brown
*Attorney, Agent, or Firm*—Basile, Weintraub and VanOphem

[57] ABSTRACT

Apparatus for casting concrete septic tanks, burial vaults and the like includes an inner form and an outer form. The inner form includes apparatus for positively locking the cover plate to the inner form as the walls thereof are expanded. The inner form, also, includes an improved mode for expanding same.

9 Claims, 6 Drawing Figures

APPARATUS FOR CASTING

BACKGROUND OF THE INVENTION

1. Field of the Invention

The present invention pertains to apparatus for casting. More particularly, the present invention pertains to casting forms for the casting of concrete septic tanks, burial vaults and the like. Even more particularly, the present invention relates to casting forms having collapsible and expandible walls and means for facilitating the collapsing and expansion thereof.

2. Prior Art

The formation of concrete septic tanks burial vaults and other such structures generally contemplates the casting thereof in a "form". The form usually comprises an inner form and an outer form spaced apart from the inner form and into which the casting material, e.g. concrete, is poured.

The outer form is usually a disassembleable rigid structure. The inner form comprises expandible and collapsible side walls and end walls. The inner form also includes a top wall or cover plate which mates with the edges of the walls.

In U.S. Pat. No. 2,807,071, the disclosure of which is hereby incorporated by reference, there is taught casting apparatus of the type under consideration herein. With respect to this apparatus, it has been found, however, that the placement of the cover plate is extremely difficult and not coordinated with the expansion of the side and end walls of the inner form.

The present invention, on the other hand, alleviates this problem. Concommitantly, the present invention also provides improved means for collapsing and expanding the walls of the inner form.

SUMMARY OF THE INVENTION

In accordance with the present invention, there is provided a casting apparatus comprising an inner form and an outer form. The outer form is a disassembleable rigid assembly spaced apart from the inner form.

The inner form includes a pair of parallel spaced apart end walls and a pair of parallel spaced apart side walls. Each of the walls are hinged such that they are collapsible and expandible.

Each of the walls are connected to a means for collapsing and expanding the walls such that the walls expand and collapse simultaneously.

The inner form also includes a top wall or cover plate which mates with the edges of the walls of the inner form. A chain or other non-extensible element interconnects the plate to the means for collapsing and expanding the walls. In this manner, movement of the cover plate is contemporaneous with the movement of the walls.

In a further embodiment of the invention, the means for collapsing and expanding the walls includes a central shaft having an axially slideable collar mounted thereon. Elongated rods or the like extend between the collar and the walls and are rigidly secured thereto. Movement of the collar is translated to the walls to effectuate expansion or retraction.

For a more complete understanding of the present invention, reference is made to the following detailed description and accompanying drawing. In the drawing, like reference characters refer to like parts throughout the several views in which:

DETAILED DESCRIPTION OF THE PREFERRED EMBODIMENTS

Figure 1:
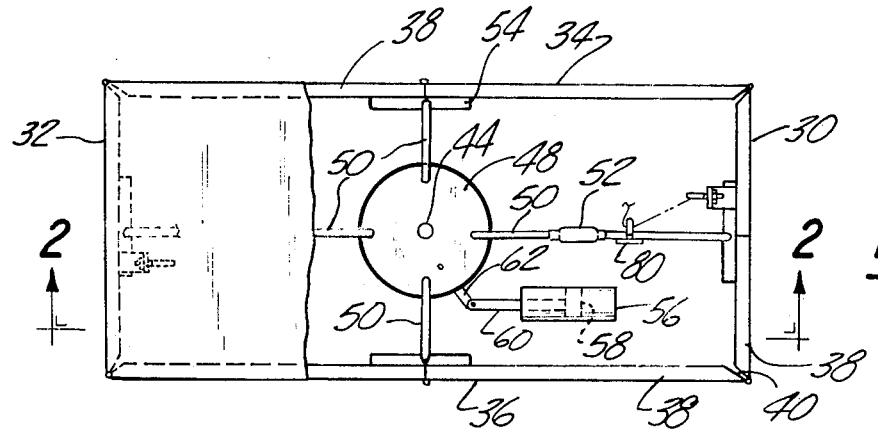
FIG. 1 is a top plan view of a casting apparatus in accordance with the present invention.

Now, with reference to the drawing, and in particular, FIGS. 1–4, there is depicted therein, a first aspect of the present invention. At the outset however, it should be noted that the description of the present invention will be made within the framework of the casting apparatus defined in the hereinbefore referenced U.S. Letters Patent. However, the present invention is equally applicable to all types of casting apparatus of the type under consideration herein.

Referring again to the drawing, the present casting apparatus, generally denoted at 10, comprises an outer form 12 and an inner form 14. The inner form 14 includes means, generally indicated at 16, for expanding and collapsing the inner form 14.

With more specificity, the present casting apparatus comprises a base support 18. Outwardly extending from the base support 18 is a flange or strip 20 which extends around the periphery of the base support to define a rectangular configuration. As clearly shown in FIG. 2, the outer form 12 includes a pair of substantially parallel end walls 22, 24. The end walls 22, 24 are pivotally connected to the base support 18, as at 26, 28. Likewise, but not shown, the outer form also includes a pair of spaced apart side walls which are also pivotally connected to the base support.

When the walls of the outer form 12 are in an upright position there is defined a substantially rectangular form.

Inwardly spaced from the outer form 12 is the inner form 14. The inner form 14 comprises a pair of parallel spaced apart end walls 30, 32 and a pair of parallel spaced apart side walls 34, 36. All of the walls 30, 32, 34, 36 cooperate to define a substantially rectangular inner form. Each top edge of the walls of the inner form includes an inwardly directed flange 38 which is cut away at its edges, as at 40, to permit collapsing and expansion of the associated wall.

Figure 3:
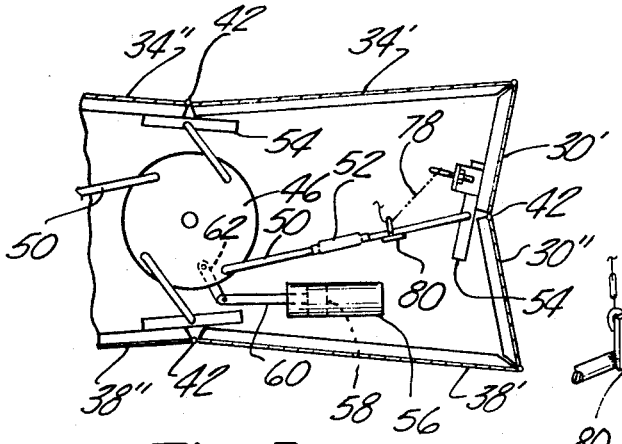
FIG. 3 is a broken, cross-sectional view taken along the line 3—3 of FIG. 2 showing the inner form with the walls thereof in a partially collapsed position.
Figure 4:
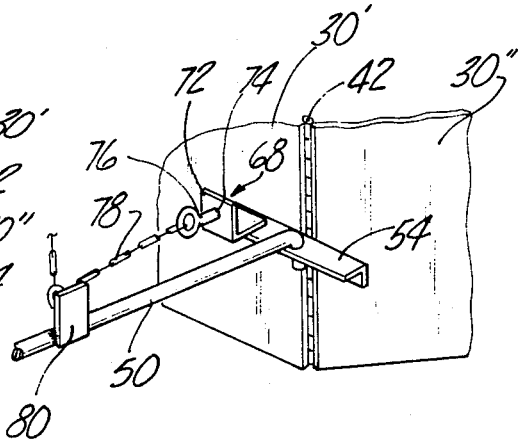
FIG. 4 is a broken, perspective view depicting the cover plate tensioning means.

As shown in FIGS. 1, 3 and 4, each wall comprises a pair of sections, respectively, denoted as 30′, 30″; 34′, 34″; 36′, 36″, etc. The sections or panels of each wall are interconnected by a hinge 42. In this manner the walls of the inner form are rendered movable in a manner to be described hereinafter.

The walls of the inner form 14 are rendered collapsible and expandable via means 16. The means 16 comprises a central shaft 44 which extends in a vertical direction and rotatably mounted in a bearing 45. Journalled on the shaft 44 is a pair of rotatable discs 46, 48. The discs are rigidly secured to and journalled onto the shaft and, thus, rotation of one disc causes rotation of the other disc and the shaft, as well.

For purposes of facilitating an understanding hereof and for the sake of simplicity, the following description with reference to the mode of collapsing and expanding the side walls, will be made with reference to the disc 46. However, it is to be understood that the following discussion is equally applicable with reference to the disc 48.

Extending radially outward from the disc 46 is a plurality of rods 50. There is provided a rod 50 for each wall. The rods are rigidly secured to the disc by any suitable means. In the drawing, the rods are shown as extending through mounting apertures provided in the disc. However, the rods can be secured to the disc in any suitable manner. The rods 50 extending to the end walls 30, 32 are rendered adjustable in length by the interposition of turnbuckles 52 or the like. An angle iron 54 is mounted to one panel or section of each wall, as shown. The angle iron 54 extends across the hinge 42 and is substantially centrally disposed with respect to the width of the associated wall. The angle iron 54 is secured to the associated wall panel by welding or the like.

The other or free ends of the rods 50 are secured to their associated angle irons 54 in any suitable manner.

It is to be, thusly, appreciated that rotation of the disc is translated to the walls by the linear movement of the rods, because of the securement thereof to the walls via the angle irons.

Rotation of the discs can be achieved through any suitable means including pneumatic, hydraulic and manual means. The means depicted in the drawing comprises a cylinder 56 having a piston 58 disposed therein. A piston rod 60 is connected to a link 62 secured to one of the discs. Thus, movement of the piston, to the right or left, moves the disc in a predetermined rotation and thereby causes either collapsing or expansion of the walls.

Figure 2:
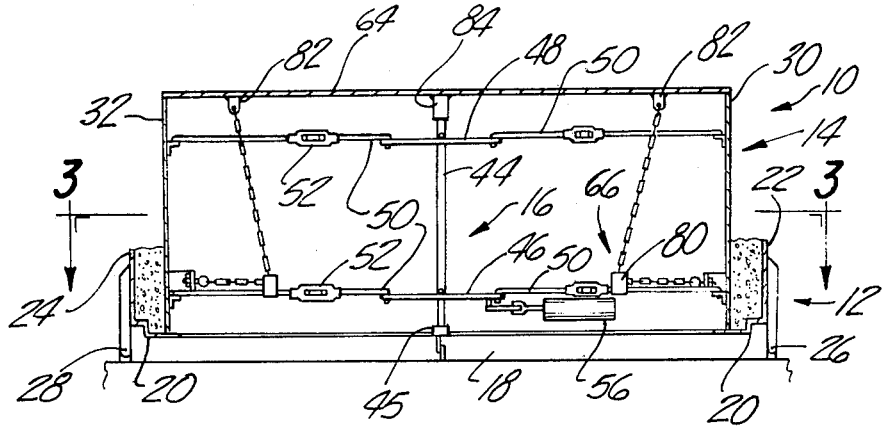
FIG. 2 is a cross-sectional view of the present invention taken along the line 2—2 of FIG. 1.

As clearly shown in FIGS. 2 and 4 associated with the inner form 14 is a cover or top plate 64. The cover plate 64 mates with the top edges of the inner form to provide a seal therearound, in a well known manner. In accordance herewith, means, generally denoted at 66, is provided for the contemporaneous movement of the cover plate 64 with the collapsing or expanding of the walls of the inner form.

The means 66 comprises a bracket 68 rigidly secured to the angle iron 54 associated with the end walls 30, 32. The bracket 68 is preferably an L-shaped bracket having one leg 70 welded to the angle iron. The other leg 72 has a threaded aperture 74 which threadably receives an eye bolt 76. Connected to the eye portion of the eye bolt 76 is one end of a link chain 78. The chain 78 extends through a similar bracket and eyebolt assembly 80 mounted on the rods 50 associated with the end walls 30,32. The other end of the chain is connected to a bracket 82 secured to the interior surface of the cover plate 64. The length of the chain 78 is predetermined such that when the end walls of the inner form are expanded, the chain is taut. It is to be further noted that the central shaft 44 is journalled at its top in a bearing 84 provided on the cover plate 64. It is to be appreciated that as the rods 50 are extended to expand the walls, via rotation of the disc, this in turn tensions the chain to pull the cover plate 64 down into mating engagement with the edges of the walls. The tensioning and pulling down occurs simultaneously with the expansion of the walls. Collapsing of the walls loosens the chain and breaks the seal.

Figure 5:
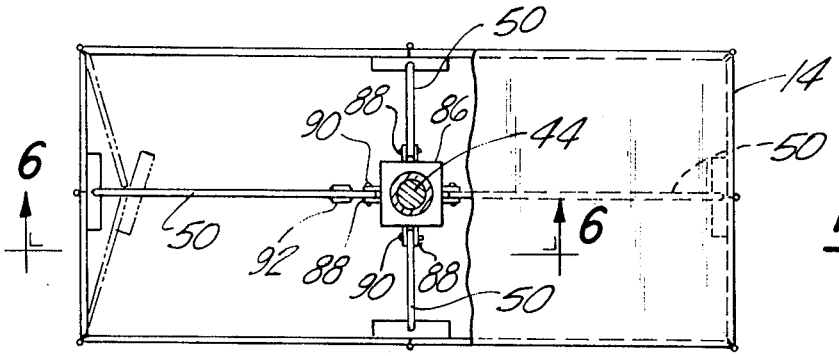
FIG. 5 is a top plan view of the casting apparatus hereof depicting another aspect of the present invention.
Figure 6:
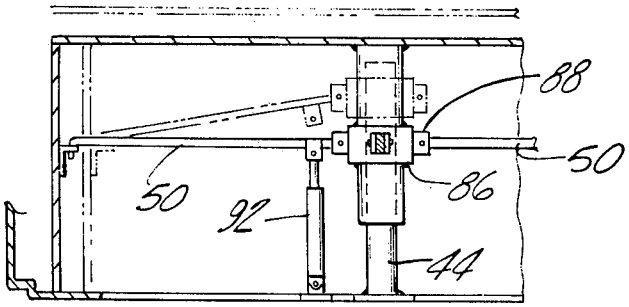
FIG. 6 is a broken, cross-sectional view, partly in phantom, taken along the line 6—6 of FIG. 5.

Referring now to FIGS. 5 and 6 of the drawing, there is depicted therein a further aspect of the present invention. According to this aspect of the invention, the rotatable discs 46, 48 are eliminated. In accordance herewith there is provided the central shaft 44, secured at both the cover plate 64 and the base 18, in the manner heretofore described. Axially slideable means, such as a slide collar 86, is mounted on the shaft 44. The slide collar 86 has a plurality of mounting brackets 88 secured thereto. The brackets comprise a pair of spaced apart legs having registering apertures provided therethrough.

In this aspect of the invention, the rods 50 have their ends associated with the slide collar provided with an aperture (not shown). The rods 50 are pivotally mounted to the brackets 88 by inserting a pin 90 or the like through the registering apertures and the aperture in the rod, as shown. Means 92 are included for moving the slide collar on the shaft. The means may be either hydraulic, pneumatic, manual or the like. The power means 92 depicted in the drawing is the same as heretofore described. In expanding or collapsing the walls of the inner form 14, the slide collar is moved up or down the shaft. Movement of the collar causes retraction of the rods 50, thereby collapsing the form. Movement of the collar down the shaft causes the expansion of the form and the drawing down of the cover plate. It should be noted in this regard that the structure shown in FIGS. 5 and 6 is the same as that shown in FIGS. 1–4 except that the axially slideable means is deployed in lieu of the rotatable discs.

Having, thus, described the invention, what is claimed is:

1. In apparatus for casting of the type including an outer form and an inner form, the inner form being of the type having horizontally translatable collapsible and expandable side walls and end walls, each of said walls being centrally hinged along the vertical extent thereof, means for expanding and collapsing the side walls and end walls by the horizontal translation thereof, the means including a central shaft, a rod associated with each wall and extending from the shaft to a mounting bracket connected to the associated wall, and a cover plate engageable with the top edges of the walls, the improvement which comprises:

a. means for moving the cover plate secured to the cover plate and interconnected to at least the end walls, the means for moving being responsive to the means for expanding and collapsing such that upon expansion of the walls by the horizontal outward translation thereof the cover plate moves into engagement with the edges of the walls simultaneously with the expansion of the walls.

2. The apparatus of claim 1 wherein the means for moving the cover plate comprises:

a. a mounting bracket secured to the interior surface of the cover plate;

b. a first chain bracket secured to the wall mounting bracket, and c. a chain connected at one end to the mounting bracket of the cover plate and to the first chain bracket secured to the wall mounting bracket at its other end.

3. The apparatus of claim 2, wherein the means for moving the cover plate further comprises:

a second chain bracket mounted on a rod, the chain extending through the second chain bracket.

4. The apparatus of claim 2 wherein the first chain bracket comprises:

a. an L-shaped bracket having a first leg secured to the wall mounting bracket, the second leg having an aperture formed therethrough, and b. an eyebolt threadably received in the aperture, the chain being connected to the eyebolt.

5. The apparatus of claim 1 wherein the means for moving the cover plate, comprises:

means axially slidably mounted on the central shaft and being telescopingly slideable thereon, the rods being pivotally connected to the axially slideable means such that the axially slideable means defines the means for expanding and collapsing the walls.

6. The apparatus of claim 5 wherein the axially slideable means comprises a slide collar mounted on the central shaft.

7. In apparatus for casting of the type including an outer form and an inner form, the inner form being of the type having collapsible and expandable side walls and end walls, means for expanding and collapsing the side walls and end walls, the means including a central shaft, a rod associated with each wall and extending from the shaft to a mounting bracket connected to the associated wall, and a cover plate engageable with the top edges of the walls, the improvement which comprises:

means for moving the cover plate into engagement with the edges of the walls simultaneously with the expansion of the walls, the means for moving comprising:

1. a mounting bracket secured to the interior surface of the cover plate,
2. a first chain bracket secured to the wall mounting bracket, and
3. a chain connected at one end to the mounting bracket of the cover plate and to the first chain bracket secured to the wall mounting bracket at its other end.

8. The apparatus of claim 7, wherein the means for moving the cover plate further comprises:

a second chain bracket mounted on a rod, the chain extending through the second chain bracket.

9. The apparatus of claim 7, wherein the first chain bracket comprises:

a. an L-shaped bracket having a first leg secured to the wall mounting bracket, the second leg having an aperture formed therethrough, and b. an eyebolt threadably received in the aperture, the chain being connected to the eyebolt.

* * * * *